US005934804A

United States Patent [19]

Branson et al.

[11] Patent Number: 5,934,804

[45] Date of Patent: Aug. 10, 1999

[54] SHAKING APPARATUS WHICH SELECTIVELY PROVIDES LINEAR OR ORBITAL SHAKING MOTION

[75] Inventors: John Branson; Terence Raymond Shaw, both of Cambridge, United Kingdom

[73] Assignee: Grant Instruments (Cambridge) Limited, Cambridge, United Kingdom

[21] Appl. No.: 09/020,878

[22] Filed: Feb. 9, 1998

[30] Foreign Application Priority Data

Feb. 12, 1997 [GB] United Kingdom ..... 97028732

[51] Int. Cl.[6] ..... B01F 11/00

[52] U.S. Cl. ..... 366/208

[58] Field of Search ..... 366/110–112, 114, 366/208–216, 219, 273, 274

[56] References Cited

U.S. PATENT DOCUMENTS

| | | | |
|---|---|---|---|
| 3,281,125 | 10/1966 | Shoe et al. | 366/111 |
| 3,601,372 | 8/1971 | Harmes, III | 366/219 |
| 4,109,319 | 8/1978 | Brandt | 366/219 |
| 4,183,677 | 1/1980 | De Bruyne | 366/209 |
| 4,750,845 | 6/1988 | Nabetani | 366/209 |
| 5,372,425 | 12/1994 | Tannenbaum et al. | 366/209 |
| 5,409,312 | 4/1995 | Fletcher | 366/208 |
| 5,564,826 | 10/1996 | Neumann et al. | 366/215 |
| 5,593,228 | 1/1997 | Tannenbaum | 366/209 |
| 5,655,836 | 8/1997 | Preston et al. | 366/208 |

FOREIGN PATENT DOCUMENTS

| | | | |
|---|---|---|---|
| 2-187138 | 7/1990 | Japan | 366/208 |

*Primary Examiner*—Charles E. Cooley
*Attorney, Agent, or Firm*—William H. Eilberg

[57] ABSTRACT

A shaking water bath suitable for laboratory use comprises a wheeled trolley 12 driven with a reciprocating movement along a linear path between guides 30, 30 by a drive mechanism which includes an eccentric rotary drive member 34 and connecting arm 36. The apparatus is contained in a water tank 16 and the trolley 12 supports a removable tray 14 for carrying receptacles containing the material to be agitated. In one position of the tray 14 complementary abutment elements 50, 52 located respectively on the tray and on the trolley interengage to prevent lateral displacement of the tray. Upon turning the tray 14 through 180° and refitting on the trolley these abutment elements 50, 52 no longer interengage to prevent lateral movement, but a drive pin 56 on the tray then engages with a drive socket 58 in the drive mechanism to cause the tray 14 to be driven with an additional component of motion at right angles to the longitudinal direction of reciprocating movement of the trolley 12. Thus, by simply interchanging the position of the tray 14 on the trolley 12 the tray can be caused to change from executing a simple linear reciprocating movement to an alternative mode in which it executes a non-linear orbital movement.

9 Claims, 5 Drawing Sheets

SHAKING APPARATUS WHICH SELECTIVELY PROVIDES LINEAR OR ORBITAL SHAKING MOTION

BACKGROUND OF THE INVENTION

1. Field of the Invention

This invention relates to shaking apparatus such as, for example, mixing devices, shaking water baths, shaking incubators and other apparatus commonly used in laboratories for agitating the contents of reaction vessels e.g. flasks or test tubes, or other containers by a shaking movement imparted thereto.

2. Description of the Related Art

In some existing designs of shaking apparatus, for example in the Applicant's SS40 series of laboratory shaking water baths, a carrier or holder for supporting reaction vessels or other receptacles for the material to be agitated is arranged to be moved along a linear path with a reciprocating movement. In other existing designs of shaking apparatus, a carrier or holder for the reaction vessels or other receptacles is arranged to be moved continuously along a non-linear orbital path, e.g. a circular or elliptical path. The choice between using shaking apparatus which provides a linear reciprocating movement for shaking and shaking apparatus which provides a non-linear orbital movement for shaking usually depends on the nature of the operation being performed and characteristics or mixing qualities of the materials involved. However, in practice the user often has a need for both kinds of shaking movement at different times and to meet this situation it has hitherto been necessary for the user either to have two separate forms of the shaking apparatus designed respectively to provide the two kinds of movement or, alternatively, in some existing designs of shaking apparatus it has been possible for the user to exchange parts of the shaking apparatus so as to convert the apparatus from one mode of operation which provides one of the two kinds of shaking movement to an alternative second mode of operation which provides the other kind of shaking movement.

SUMMARY OF THE INVENTION

An object of the present invention is to provide shaking apparatus which can more readily be converted from one mode of operation to an alternative mode of operation to provide selectively either a linear reciprocating shaking movement or a non-linear orbital shaking movement.

More specifically, the present invention provides shaking apparatus having a carrier or holder for supporting material to be shaken wherein said carrier or holder is selectively mountable in the apparatus so as to be driven by shaking drive mechanism of the apparatus in either a first operating mode in which the carrier or holder is driven so as to execute only a linear reciprocating movement or an alternative second operating mode in which the carrier or holder is driven so as to execute a non-linear orbital movement.

In preferred embodiments the carrier or holder is adapted to be mounted in the apparatus in either one of two different interchangeable positions, namely a first interchangeable position in which it is operatively engaged with said shaking drive mechanism of the apparatus such as to be driven in said first operating mode, and a second alternative interchangeable position in which it is operatively engaged with said shaking drive mechanism such as to be driven in said second operating mode.

This may conveniently be achieved by arranging for the carrier or holder to be supported in each of said alternative interchangeable positions on a carriage which is driven by the shaking drive mechanism of the apparatus so as to provide a longitudinal reciprocating movement along a linear path whereby the carrier or holder also moves with a component of motion along the same linear path as said carriage. In addition, interengageable abutment means are provided on the carrier or holder and on the carriage which, when said carrier or holder is mounted in said first interchangeable position, are operative to restrict or prevent relative lateral movement between the carriage and said carrier or holder so that the latter is constrained to move only in a substantially linear path in a longitudinal direction in unison with said carriage, but when said carrier or holder is mounted in said second interchangeable position said interengageable abutment means are no longer operative to restrict or prevent relative lateral movement between said carrier or holder and the carriage, and said carrier or holder is arranged then to be driven by the shaking drive mechanism with an additional component of reciprocating motion at right angles to the linear path of motion of the supporting carriage whereby said carrier or holder is caused to move relative to said carriage and to execute a non-linear orbital motion.

In preferred embodiments the abutment means referred to above comprises complementary tongue and slot abutment elements which are located respectively on the two parts, i.e. on the carrier or holder and on the carriage, and which interengage when the carrier or holder is in said first interchangeable position but which do not interengage when said carrier or holder is in said second interchangeable position.

The carrier or holder supporting carriage is conveniently in the form of a trolley which is guided for reciprocating movement along a linear path by appropriate guide tracks. Also, in preferred embodiments the carrier or holder is supported upon the trolley through a set of wheels or rollers oriented at right angles to running wheels or rollers at the underside of the trolley, thereby permitting relative movement between the trolley and said carrier or holder in a lateral direction at right angles to the longitudinal direction of travel of the trolley.

In preferred embodiments the shaking drive mechanism includes a motor-driven eccentric drive arrangement such as a cam or crank operatively connected through a connecting arm to the trolley, thereby providing a reciprocating drive arrangement for the trolley. For causing the carrier or holder to move with an orbital motion, complementary coupling means, such as a drive pin and socket arrangement for example, can be provided on the carrier or holder and on a drive member, for instance the aforesaid connecting arm, of the reciprocating drive arrangement of the trolley, these complementary coupling means being arranged to interengage and thereby to impart a lateral component of reciprocating motion to the carrier or holder when the latter is placed in a first position on the trolley. Upon removing and replacing the tray on the trolley after turning it through 180° in a horizontal plane, these complementary coupling means disengage but other complementary abutment means as hereinbefore referred to may then be brought into interengagement so as to prevent lateral movement of the carrier or holder which is then restricted solely to reciprocating movement along a linear path in unison with the trolley.

Also in preferred embodiments the reciprocating drive arrangement for the trolley incorporates shock absorbing means, including a resilient shock absorbing member for example, for reducing the mechanical shock that tends to occur at the end of each reciprocal stroke of the drive mechanism.

The carrier or holder will commonly be in the form of a tray or platform, but for convenience it will hereinafter generally be referred to simply as a tray.

Where a controlled temperature environment is required such as in a laboratory water bath, the apparatus will normally be contained in a tank and, as with known prior art shaking water baths, the shaking drive mechanism may be powered through a magnetic coupling by an electric motor located beneath the tank.

Further preferred and advantageous features of the invention will become apparent in the following more detailed description of one preferred embodiment, presented solely by way of example, in relation to a shaking water bath which is illustrated to the accompanying diagrammatic drawings.

DESCRIPTION OF THE PREFERRED EMBODIMENTS

Figures 1, 1A:
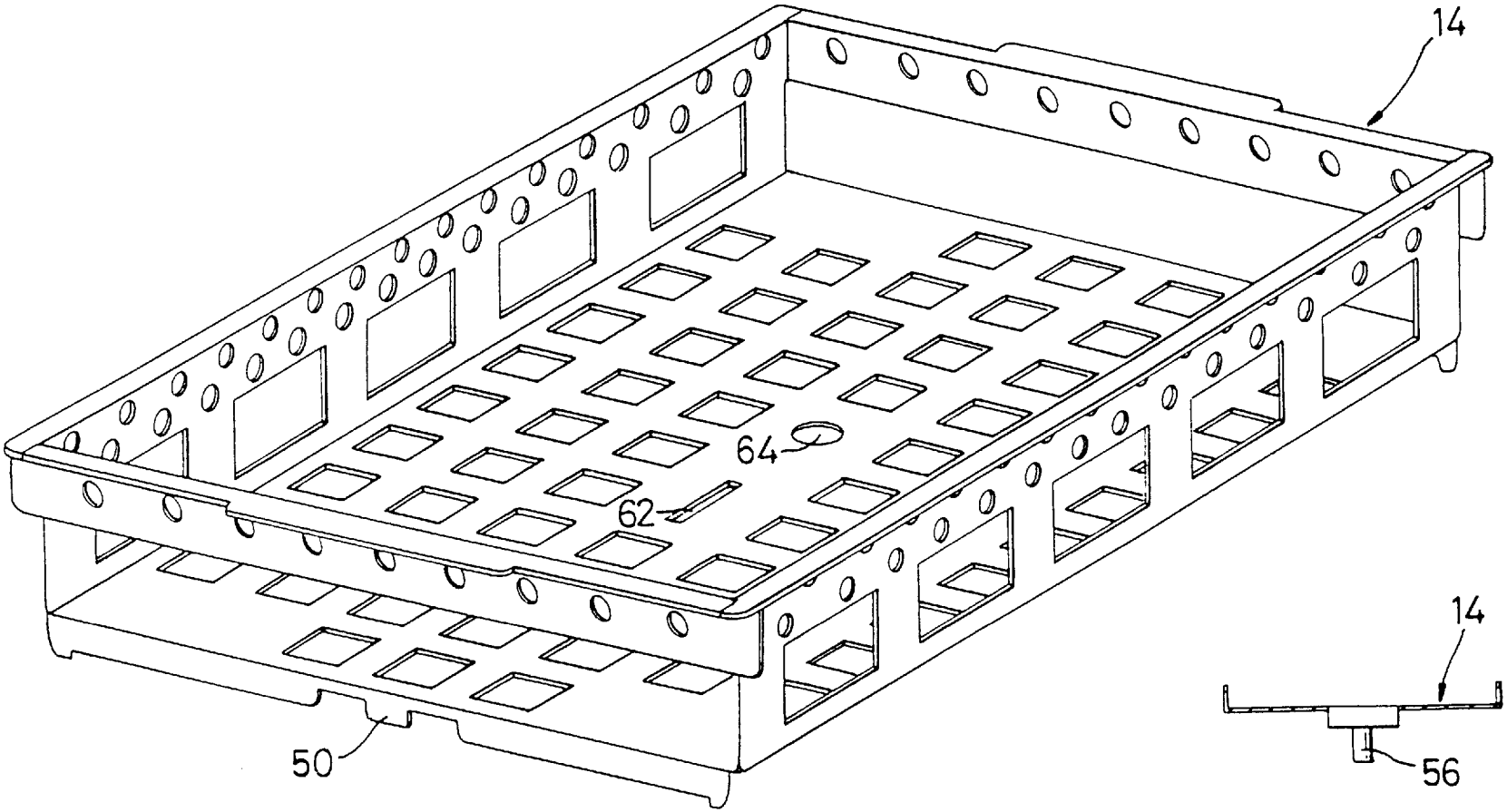
FIG. 1 is a perspective view of a carrier or holder component in the form of a tray for supporting material to be shaken contained in reaction vessels or other receptacles.
FIG. 1A is a detail view showing a drive pin on the underside of the tray which is operative when the tray is positioned in the apparatus for orbital shaking motion.

Referring to the drawings, the shaking water bath illustrated therein comprises a reciprocally movable carriage in the form of a wheeled trolley 12 upon which is mounted a shallow rectangular tray 14 that, in use, supports the material which is to be shaken or agitated, this material usually being contained in receptacles or reaction vessels such as flasks or test tube racks placed on the tray 14. In this embodiment the apparatus is contained within a tank 16 which, in use, is filled with water up to a level 17 sufficient to immerse the tray 14, and the water can be heated to a required temperature under thermostatic control by a heater 18 conveniently located under the tank 16.

Figure 4:
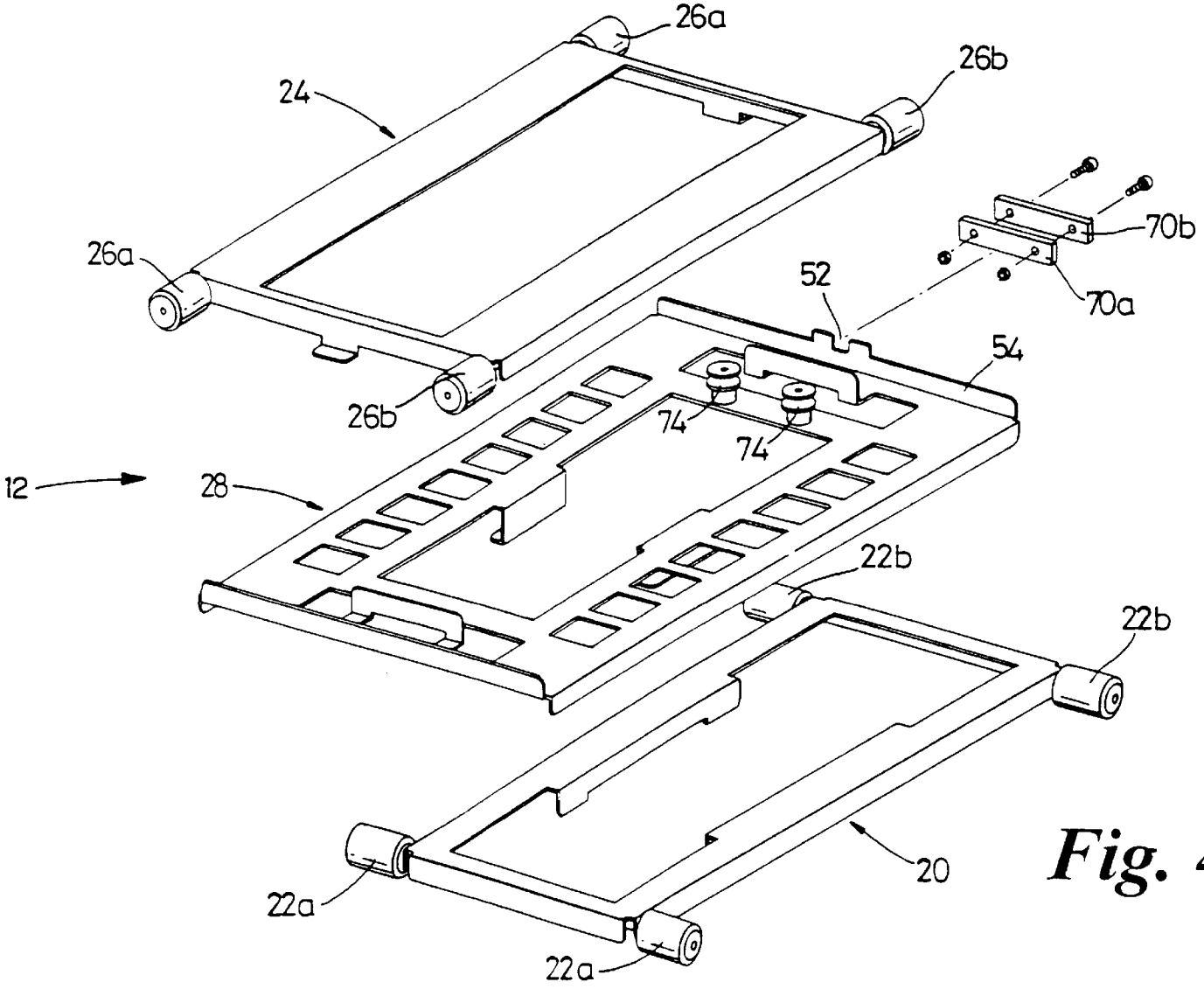
FIG. 4 is an exploded view of the trolley shown in FIG. 3.

As shown most clearly in FIG. 4, the trolley 12 is constructed from three interlocking sheet metal (stainless steel) parts, namely a lower frame member 20 which carries two pairs of wheels 22*a* and 22*b* that are rotatable about axes transverse to the longitudinal axis of the trolley, an upper frame member 24 which carries two pairs of wheels 26*a* and 26*b* rotatable about axes parallel to the longitudinal axis of the trolley, and a main body frame member 28 sandwiched between the lower and upper frame members 20 and 24.

The lower set of wheels 22*a* and 22*b* engage a base plate 29 within the tank 16 and side flanges 30 of this base plate 29 form longitudinal guides for the wheels 22*a* and 22*b* whereby the trolley 12 is guided to move with a reciprocating movement to a limited extent along a linear path inside the tank 16.

The trolley 12 is driven from a motor (not shown) outside and below the tank 16 through a magnetic coupling 32 and a shaking mechanism inside the tank. The shaking mechanism comprises a cam or eccentric member 34 pivotally coupled to the inner end of a channel-section connecting arm 36 which is operatively connected at its outer end to the main body frame member 28 of the trolley 12.

Figure 5:
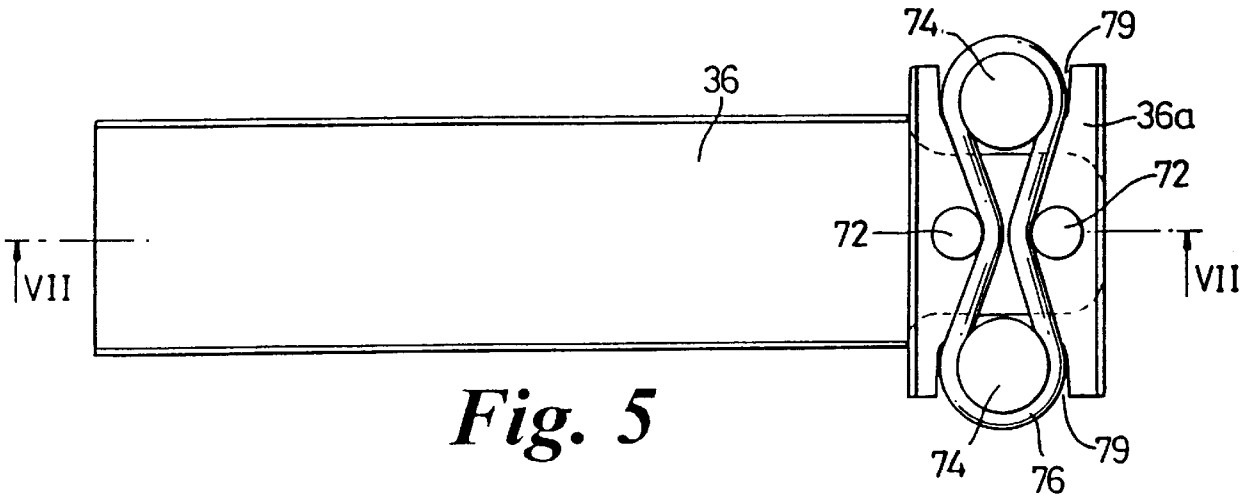
FIG. 5 is a diagram showing in plan view the connecting arm of the drive mechanism and the manner in which it is operatively engaged with the trolley.
Figure 6:
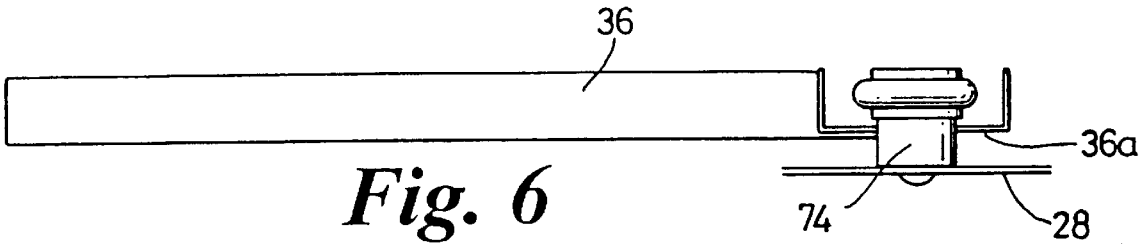
FIG. 6 is a side elevational view of the connecting arm feature shown in FIG. 5.
Figure 7:
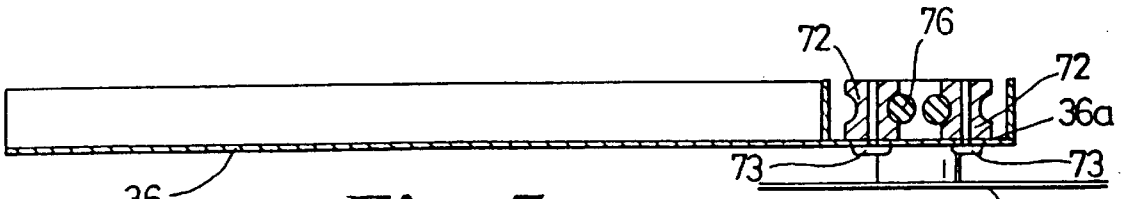
FIG. 7 is a longitudinal cross-section on line VII—VII of FIG. 5.

As will be seen from FIGS. 3, 5, 6 and 7, in this embodiment the outer end of the channel section sheet metal member forming the connecting arm 36 has a short transverse segment 36*a* that is fitted with a pair of upstanding waisted bushes or posts 72, 72 slightly spaced apart along the longitudinal axis of the arm and held in place by retaining fasteners 73. These bushes or posts engage a taut elastomeric belt or band 76, in the form for example of a circular section rubber belt, that passes around a pair of grooved posts or pulleys 74, 74 which are laterally spaced apart on the main body frame member 28 of the trolley and which pass through cut-outs 79 formed at opposite sides of the connecting arm segment 36*a*, as indicated in FIG. 5. If desired, the outer end of the connecting arm 36 could of course be pivotally connected directly to the main body frame member 28 of the trolley, but the arrangement described and illustrated is preferred because the resilient belt or band 76 introduces a useful shock absorber effect and reduces the mechanical shock that tends to occur at the end of each reciprocal stroke of the drive mechanism.

Figure 2:
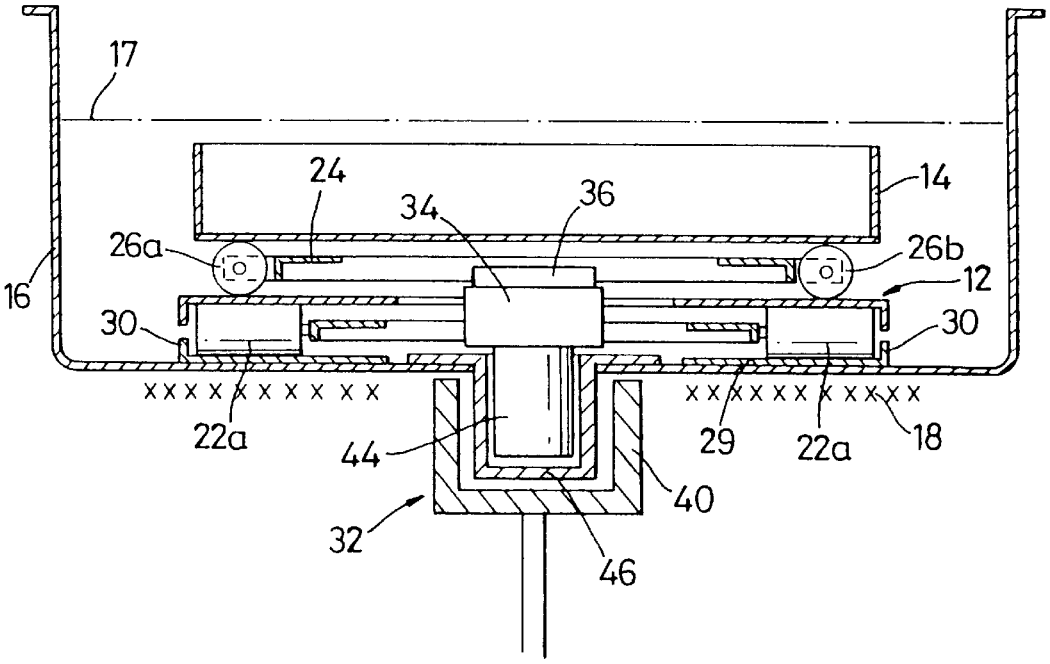
FIG. 2 is a vertical cross-sectional view in a direction transverse to the longitudinal axis of a trolley component that supports the tray of FIG. 1.

The magnetic coupling 32 comprises a cylindrical magnet 40 which is driven for rotation about a vertical axis by the external drive motor, and a shaft 44 which carries the cam or eccentric member 34 forms a cylindrical magnet follower inside the tank. An aperture in the bottom of the tank is closed by a cup shaped metallic bush component 46, and the magnet 40 is arranged externally of this bush component 46 as shown in FIG. 2.

The cam 34 acts as a crank and as it rotates the connecting arm 36 drives the trolley 12 with a reciprocating movement along a linear path guided by the lower wheels 22*a* and 22*b* and the base plate guide flanges 30.

The tray 14 is mounted on the trolley 12 and, by virtue of the upper pairs of wheels 26*a* and 26*b* which permit limited lateral movement relative to the trolley, including limited lateral movement between the upper frame member 24 and the main body frame member 28, the tray is able to move in two directions at right angles to each other. However, the way in which the tray 14 moves in use depends on the position in which it is fitted to the trolley 12.

In a first position of the tray 14 which provides a linear reciprocating movement for shaking vessels carried by the tray, a depending lug or tongue forming an abutment stop 50 (FIG. 1) at one end of the tray engages in a slot 52 formed in a flange 54 at one end of the main body frame 28 of the trolley 12, thereby preventing any significant lateral movement of the tray relative to this part of the trolley. For additional security, a pair of slightly resilient plastic retainer strips 70*a*, 70*b*, (see FIG. 4) are clamped across the slot 52 so as to frictionally engage the lug or tongue 50 when the tray is mounted in this first position, thereby to reduce any relative lateral movement arising from manufacturing tolerances in fabricating the components of the trolley.

To obtain an orbital shaking movement, the tray 14 is lifted off the trolley 12, turned round through 180° in a horizontal plane, and it is then replaced. The tongue or lug 50 then no longer engages in the slot 52 but a depending drive pin 56 positioned off centre on the underside of the tray 14 (see FIG. 1A) now engages a selected drive socket or hole 58 at the inner end of the connecting arm 36. As this hole 58 moves when the cam or eccentric member 34 is rotating, the tray 14 is driven through drive pin 56 so as to move with a component of movement at right angles to the longitudinal direction of travel of the trolley 12. The tray 14 is thereby caused to move in a non-linear orbital path by the two components of motion imparted to it.

Figure 3:
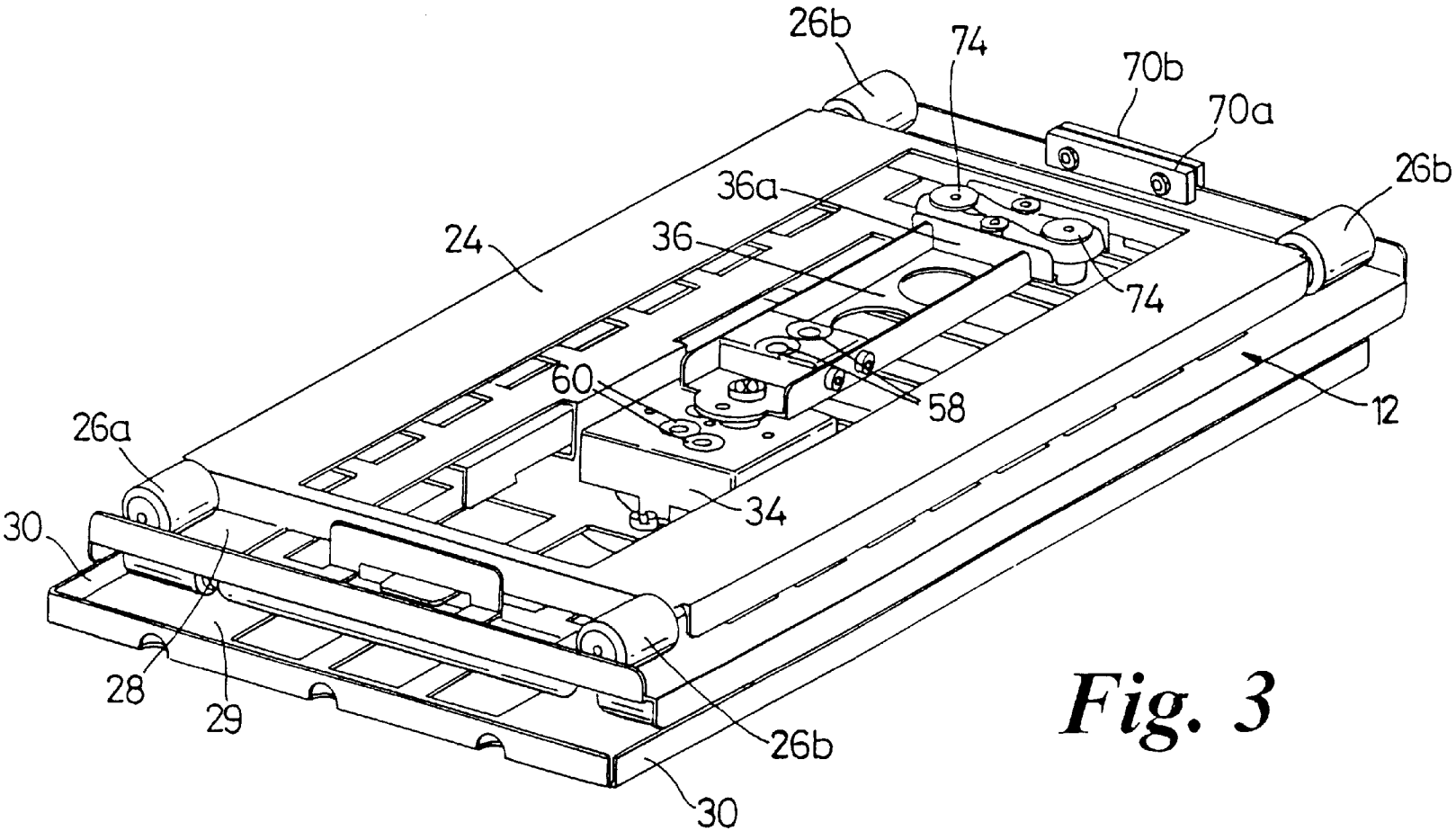
FIG. 3 is a perspective view showing the trolley in more detail, together with part of a cam or eccentric and connecting arm drive mechanism.

As seen in FIG. 3, the cam or eccentric 34 may be provided with additional pivot holes 60 whereby the connecting arm 36 can be engaged in different positions, thereby to vary the stroke of the reciprocating motion.

It will be appreciated that with this construction, it is very easy to convert the apparatus from a linear reciprocating mode of shaking operation to a non-linear orbital mode of shaking operation, and vice versa, simply by turning the carrier or holding tray 14 through 180° into its alternative mounting position. In the linear reciprocating mode of operation, the tray 14 is prevented from moving sideways by the interengaging complementary slot and abutment stop arrangement, 52 and 50, and the drive pin 56 on the underside of the tray lies out of engagement with the complementary drive socket or hole 58 in the connecting arm 36. In contrast, in the orbital mode when the tray is reversed and mounted in its other interchangeable position the lug or stop 50 is positioned at the end of the tray which is remote from the slot 52 on the trolley 12 so that it is inoperative and no longer prevents relative lateral or sideways movement. And, on the other hand, the pin 56 then engages with the selected hole 58 in the connecting arm and imparts a sideways motion which, in combination with the reciprocating motion, causes the tray to move in an orbital path.

To provide a visual indication of the mode of operation for which the tray is set at any particular instant, the tray in conveniently provided with some form of indicating means located off-centre, such as the slot 62 and circular hole 64 shown in FIG. 1.

Although a shaking water bath has been described by way of example, it will be appreciated that the same arrangement may also be applied to other forms of shaking apparatus where it is desirable or advantageous to have a choice of either linear reciprocating movement or orbital movement without need for additional parts or components, e.g. a shaking incubator, a shaking heating block, or merely a simple mixer device.

It will be seen that the invention presents a number of different aspects and it should be understood that it embraces within its scope all novel and inventive features and aspects herein disclosed, either explicitly or implicitly and either singly or in combination with one another. Also, many detail modifications or alterations may be made within the scope of the invention in respect of the particular constructional details herein described in the exemplary embodiment and, in particular, the scope of the invention is not to be construed as being limited by the illustrative example(s) or by the terms and expressions used herein merely in a descriptive or explanatory sense.

What is claimed is:

1. A shaking apparatus comprising:

a) a carrier for supporting material to be shaken, b) a carriage having means for supporting the carrier, wherein the supporting means comprises means for permitting the carrier to be lifted off the carriage and to be replaced in one of two mutually-opposite orientations, and c) the carriage being connected to a shaking drive mechanism, wherein the carrier includes first and second means for engagement with the carriage, wherein the carriage includes a first engagement member, the first engagement member being positioned to be engaged by the first means for engagement only when the carrier is in a first of said two orientations, wherein the carriage includes a second engagement member, the second engagement member being positioned to be engaged by the second means for engagement only when the carrier is in a second of said two orientations, the apparatus including means for converting motion, produced by the shaking drive mechanism, into linear shaking motion of the carrier only when the carrier is in the first orientation, and into orbital shaking motion of the carrier only when the carrier is in the second orientation.

2. The apparatus of claim 1, wherein the first means for engagement comprises a lug formed on the carrier, and wherein the first engagement member comprises a slot formed in the carriage, the slot being shaped to receive the lug.

3. The apparatus of claim 1, wherein the second means for engagement comprises a drive pin formed on the carrier, and wherein the second engagement member comprises a hole formed in the carriage, the hole being sized to receive the drive pin.

4. The apparatus of claim 1, wherein the carriage comprises a trolley which is guided for reciprocating movement along a linear path by guide track means.

5. The apparatus of claim 4, wherein the carrier is supported upon the trolley through a first plurality of wheels oriented at right angles to a second plurality of wheels located at an underside of the trolley, wherein the first and second plurality of wheels comprises means for permitting relative movement between the trolley and the carrier in a lateral direction, at right angles to a longitudinal direction of travel of the trolley.

6. In a shaking apparatus, the shaking apparatus including a carrier and a carriage having means for supporting the carrier, the carriage including means for selectively imparting linear shaking motion or orbital shaking motion to the carrier, the improvement wherein:

the supporting means comprises means for permitting the carrier to be lifted off the carriage and to be replaced in one of two distinct orientations, and the means for selectively imparting motion comprises means for imparting linear shaking motion to the carrier when the carrier is in a first orientation, and for imparting orbital shaking motion to the carrier when the carrier is in a second orientation.

7. The improvement of claim 6, wherein said first and second orientations are mutually opposite.

8. The improvement of claim 7, wherein the means for imparting linear shaking motion to the carrier operates only when the carrier is in the first orientation, and wherein the means for imparting orbital shaking motion operates only when the carrier is in the second orientation.

9. The improvement of claim 6, wherein the carrier includes a lug and a drive pin, and wherein the carriage includes a slot and a hole, and wherein the lug and slot are positioned such that the lug engages the slot when the carrier is in the first orientation, and wherein the drive pin and the hole are positioned such that the drive pin engages the hole when the carrier is in the second orientation.

* * * * *